US006895851B1

(12) United States Patent
Adams et al.

(10) Patent No.: US 6,895,851 B1
(45) Date of Patent: May 24, 2005

(54) MULTI-STRUCTURE METAL MATRIX COMPOSITE ARMOR AND METHOD OF MAKING THE SAME

(75) Inventors: Richard Adams, Marlboro, MA (US); Mark Occhionero, Milford, MA (US)

(73) Assignee: Ceramics Process Systems, Chartley, MA (US)

( * ) Notice: Subject to any disclaimer, the term of this patent is extended or adjusted under 35 U.S.C. 154(b) by 0 days.

(21) Appl. No.: 10/462,547

(22) Filed: Jun. 16, 2003

(51) Int. Cl.[7] ..... F41H 05/04
(52) U.S. Cl. ..... 89/36.02; 428/547; 428/548
(58) Field of Search ..... 89/36.01–36.05; 2/2.5; 428/547, 548; 109/49.5

(56) References Cited

U.S. PATENT DOCUMENTS 3,547,180 A * 12/1970 Ray et al. ..... 164/61
3,633,520 A * 1/1972 Stiglich, Jr. ..... 109/82
4,800,065 A * 1/1989 Christodoulou et al. .... 420/129
5,047,182 A * 9/1991 Sundback et al. ..... 264/28
5,114,772 A * 5/1992 Vives et al. ..... 428/49
5,164,536 A * 11/1992 Barbaza et al. ..... 89/36.11
5,167,271 A * 12/1992 Lange et al. ..... 164/103
5,421,087 A * 6/1995 Newkirk et al. ..... 29/897.2
5,970,843 A * 10/1999 Strasser et al. ..... 89/36.02
6,135,006 A * 10/2000 Strasser et al. ..... 89/36.05
6,314,858 B1 * 11/2001 Strasser et al. ..... 89/36.02
6,609,452 B1 * 8/2003 McCormick et al. ..... 89/36.01
6,635,357 B2 * 10/2003 Moxson et al. ..... 428/548
6,679,157 B2 * 1/2004 Chu et al. ..... 89/36.02
6,698,331 B1 * 3/2004 Yu et al. ..... 89/36.02
2002/0088340 A1 * 7/2002 Chu et al. ..... 89/36.02
2002/0178900 A1 * 12/2002 Ghiorse et al. ..... 89/36.02

* cited by examiner

*Primary Examiner*—Michael Carone
*Assistant Examiner*—Troy Chambers

(57) ABSTRACT

A lightweight armor system may comprise multiple reinforcement materials layered within a single metal matrix casting. These reinforcement materials may comprise ceramics, metals, or other composites with microstructures that may be porous, dense, fibrous or particulate. Various geometries of flat plates, and combinations of reinforcement materials may be utilized. These reinforcement materials are infiltrated with liquid metal, the liquid metal solidifies within the material layers of open porosity forming a dense hermetic metal matrix composite armor in the desired product shape geometry. The metal infiltration process allows for metal to penetrate throughout the overall structure extending from one layer to the next, thereby binding the layers together and integrating the structure.

19 Claims, 2 Drawing Sheets

MULTI-STRUCTURE METAL MATRIX COMPOSITE ARMOR AND METHOD OF MAKING THE SAME

FIELD OF THE INVENTION

This invention relates to lightweight armor systems in general and more specifically to an integrated, multi-laminate, multi-material system.

BACKGROUND OF THE INVENTION

Many different kinds of lightweight armor systems are known and are currently being used in a wide range of applications, including, for example, aircraft, light armored vehicles, and body armor systems, wherein it is desirable to provide protection against bullets and other projectiles. While early armor systems tended to rely on a single layer of a hard and brittle material, such as a ceramic material, it was soon realized that the effectiveness of the armor system could be improved considerably if the ceramic material were affixed to or "backed up" with an energy absorbing material, such as high strength Kevlar fibers. The presence of the energy absorbing backup layer tends to reduce the spallation caused by impact of the projectile with the ceramic material or "impact layer" of the armor system, thereby reducing the damage caused by the projectile impact. Testing has demonstrated that such multi-layer armor systems tend to stop projectiles at higher velocities than do the ceramic materials when utilized without the backup layer. While such multi-layer armoring systems are being used with some degree of success, they are not without their problems. For example, difficulties are often encountered in creating a multi-layered material structure having both sufficient mechanical strength as well as sufficient bond strength at the layer interfaces.

Partly in an effort to solve the foregoing problems, armor systems have been developed in which a "graded" ceramic material having a gradually increasing dynamic tensile strength and energy absorbing capacity is sandwiched between the impact layer and the backup layer. An example of such an armor system is disclosed in U.S. Pat. No. 3,633,520 issued to Stiglich and entitled "Gradient Armor System," which is incorporated herein by reference for all that it discloses. The armor system disclosed in the foregoing patent comprises a ceramic impact layer that is backed by an energy absorbing ceramic matrix having a gradient of fine metallic particles dispersed therein in an amount from about 0% commencing at the front or impact surface of the armor system to about 0.5 to 50% by volume at the backup material. The armor system may be fabricated by positioning successive layers of powder mixtures comprising the appropriate volume ratios of ceramic and metallic materials in a graphite die and onto a graphite bottom plunger. A top plunger is placed in the die in contact with the powder layers and the entire assembly is thereafter placed within an induction coil. Power is applied to the induction coil to heat the powder and die. Substantial pressure (e.g., about 8,000 psi) is then applied to the die to sinter the powder material and form the gradient armor system. While the foregoing type of armor system was promising in terms of performance, the powder metallurgy process used to form the graded composite layers proved difficult to implement in practice. Consequently, such armor systems have never been produced on a large-scale basis.

SUMMARY OF THE INVENTION

A lightweight armor system according to the present invention may comprise multiple reinforcement materials layered within a single metal matrix casting. The multiple reinforcement materials can include an infinite combination of reinforcement material types and geometries. These reinforcements may comprise inorganic material systems such as ceramics, metals or composites with microstructures that may be porous, dense, fibrous, or particulate. Other reinforcement layers include dense ceramic structures containing interior voids or hollow regions and ceramic fabrics including ceramic-fiber weaves. The geometries can be in the form of flat plates of varying thickness, of multiple sequences and combinations of the reinforcing materials, and in the forms of spikes, spheres, rods, etc. The reinforcement materials are infiltrated with liquid metal which solidifies within the material layers of open porosity. The liquid metal also bonds the materials together to create a coherent structure. The reinforcement materials can be selected according to their individual fractions of void volume, or lack thereof in dense materials, that are to be infiltrated with liquid metal. The selection of different reinforcement material types allows the designer to vary thermal expansion coefficients throughout the structure to create varying stress states for increased effectiveness of the armor system. The selection of different reinforcement types may also be based on strength, toughness, and weight attributes of the individual material types desirable for projectile impact protection.

A process for producing a lightweight armor system may comprise the steps of 1.) positioning stacked layers of reinforcement materials within a mold chamber of a closed mold and 2.) infiltrating the reinforcement materials with a liquid metal and allowing for the metal to solidify to form a metal matrix composite. The liquid metal is introduced under pressure into the casting mold and infiltrates and encapsulates the stacked layers of reinforcement materials within the mold. The mold chamber is fabricated to create the final shape or closely approximate that desired of the final product.

BRIEF DESCRIPTION OF THE DRAWINGS

The invention is best understood from the following detailed description when read in connection with the accompanying drawings, which illustrate an embodiment of the present invention.

DETAILED DESCRIPTION OF THE INVENTION

Figure 1:
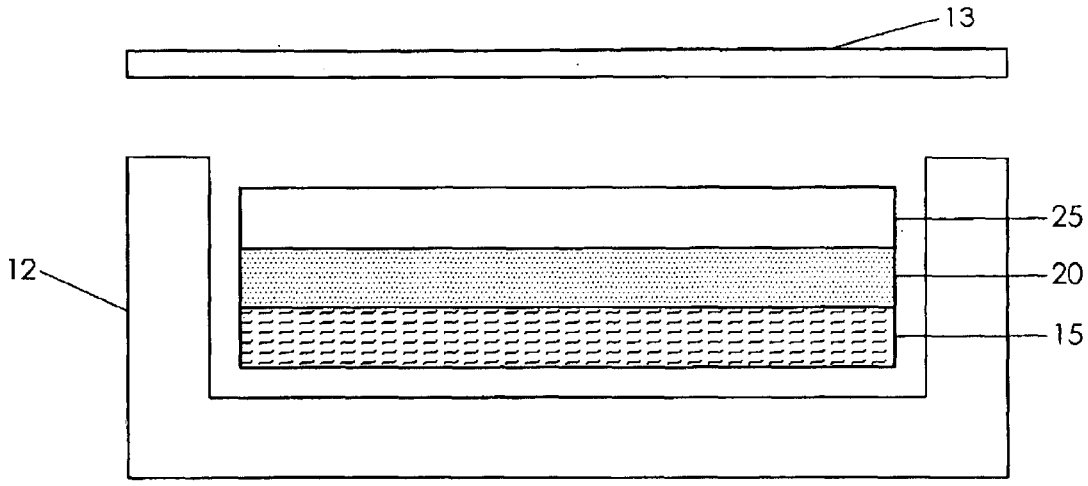
FIG. 1 is a cross sectional view of the "layup" or reinforcement layers which are set in a mold chamber 12 and include layers of hard material 25, and reinforcement materials 15 and 20.
Figure 2:
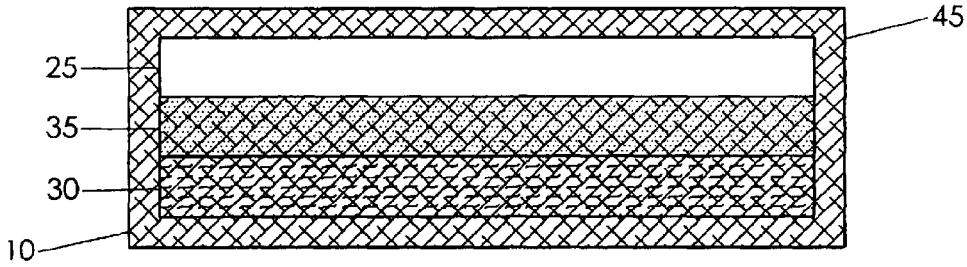
FIG. 2 is a cross sectional view of an armor system produced according to the process of the present invention showing the product of the metal casting in the form of a metal skin 45, a hard layer 25, and metal matrix composite layers 30 and 35.
Figure 3:
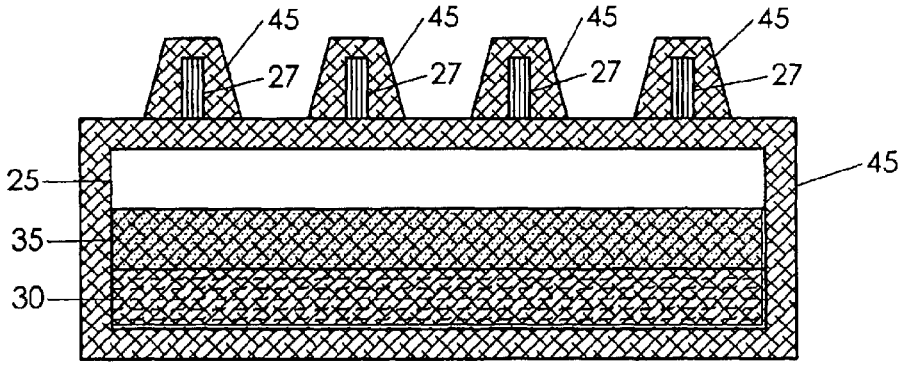
FIG. 3 is a cross sectional view of an armor system produced according to the process of the present invention showing the product of the metal casting in the form of a metal skin 45 enveloping spikes or rods 27, a hard layer 25, and metal matrix composite layers 30 and 35.
Figure 4:
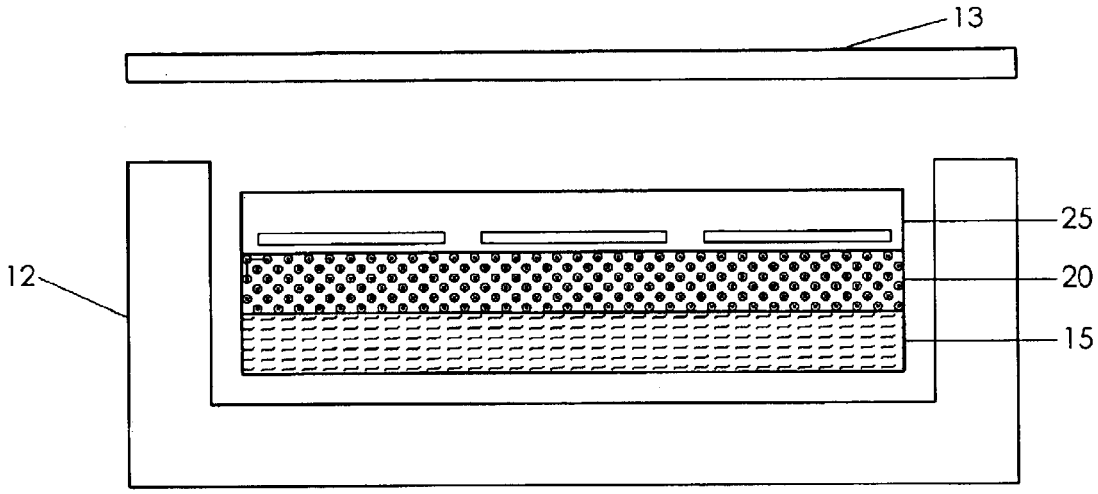
FIG. 4 is a cross sectional view of the "layup" or reinforcement layers which are set in a mold chamber 12 and include layers of hard material 25, and reinforcement materials 15 and 20, with "crush zones" within layers 20 and 25.

A lightweight armor system 10 according to the present invention is best seen in FIGS. 1 through 5 and may comprise a multi-layer combination of hard or dense substances and ductile components. FIG. 1 illustrates a "layup" or combination of reinforcing constituents. The reinforcement comprises a microstructure designed to have a predetermined fraction of void volume or open structure that is to be subsequently filled with molten metal. The shape of the "layup" is determined by the dimensions of the casting cavity 12 used to create a single integrated solid structure. The layered materials 15,20, and 25 would be set into a casting mold in an amount necessary to conform to the shape of the mold. In one embodiment the "layup" may include a combination of reinforcement material layers such as a reinforcement layer 15 of carbon fiber, at a volume of 20% or more, a reinforcement layer 20 of silicon carbide preform, at a 20% or more volume, and a hard layer 25 of dense ceramic such as aluminum oxide, silicon carbide, boron nitride, silicon nitride, or chemical vapor deposit diamond. A hard layer of a high density metal such as depleted uranium, tungsten, titanium and molybdenum may also be utilized. Other suitable reinforcement materials include but are not limited to ceramics such as aluminum nitride, aluminum oxide, boron nitride, diamond, graphite, carbon, and silicon nitride; ceramic alloys such as alumino silicates, silicon aluminum oxy-nitrides; metals such as depleted uranium, tungsten, and molybdenum; and glass. It is understood that all reinforcement materials disclosed and their equivalents may be either in dense, particulate or fibrous form. Furthermore, other reinforcement layers of amorphous or polycrystalline structure material deemed suitable for ballistic resistance and hard layers of high strength steels, metal alloys, and ceramic alloys may be utilized in subject invention. It is also understood that the "layup" disclosed herein is illustrative of one embodiment of subject invention and that subject invention may comprise multiple reinforcement layers and multiple hard layers arranged in any manner suitable for ballistic resistance. The reinforcement material layers and hard layers may comprise one or more open or void spaces or "crush zones" that are sealed within the layers to prevent metal infiltration during the metal infiltration casting process. These crush zones may be in the form of particulate reinforcements in which the particulates are "hollow" or contain closed porosity, for example, hollow ceramic spheres contained within the particulate reinforcement layer. These "crush zones" may also be in the form of ceramic or metal plates which contain closed porosity or cavities. These micro or macro-scale closed porosity structures or cavities can be formed within a plate or reinforcement utilizing conventional processing methods known in the art. FIG. 4 illustrates "crush zones" within reinforcement layer 20 and hard layer 25. The volume fraction of reinforcement material is determined by its type, and selected according to desired ballistic resistance properties, and by the final CTE requirement of the particular layer of the integrated structure. For example, in the case of a SiC particulate preform infiltrated with molten aluminum, the volume fraction of SiC is in the range of 0.20 to 0.70 and is sufficient to obtain composite CTE values in the range of 6 to 13 or more ppm/degree Celsius when exposed to temperatures in the range of −50 to 150 degree celsius. In a structure having graphite fiber reinforce ment, the volume fraction of 0.60 graph ite fibers is sufficient enough to produce CTE values of less than 5 ppm/degree Celsius. A hard layer 25 of dense BN plate may have a CTE value of 4 ppm/degree celsius. A process of forming a reinforcement constituent, which may be utilized in subject invention, is disclosed in U.S. Pat. No. 5,047,182, incorporated herein by reference for all it discloses.

Figure 5:
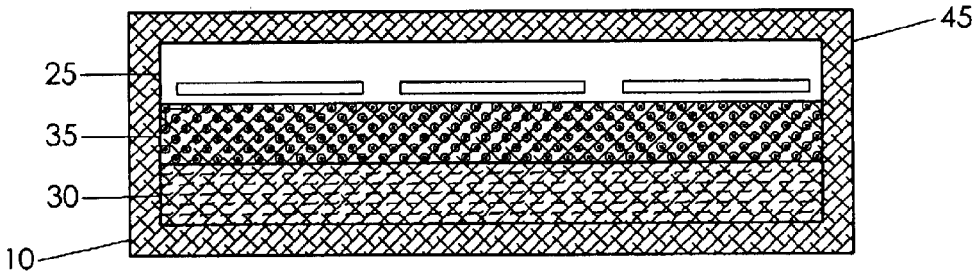
FIG. 5 is a cross sectional view of an armor system produced according to the process of the present invention showing the product of the metal casting in the form of a metal skin 45, a hard layer 25, metal matrix composite layers 30 and 35, and "crush zones" contained within layers 25 and 35.

These reinforcement layers are placed into a mold cavity 12 suitable for molten metal infiltration casting. The reinforcement mold cavity is typically prepared from a graphite die suitable for molten metal infiltration casting with the dimensions defined to produce a multi-structure metal matrix composite. A lid 13 defines the mold cavity 12 prior to infiltration casting. The layered reinforcement material is next infiltrated with molten aluminum to form a dense hermetic metal matrix composite in the desired product shape geometry. Referring to FIG. 2, any open voids within the reinforcement layers are filled with aluminum during the Al infiltration process, creating metal infiltrated reinforcement layers 30, 35. The hard layer 25 is bonded to reinforcement layer 35 during Al infiltration and upon completion of the Al infiltration process all layers 25, 30, and 35 are bonded together or encapsulated by aluminum skin 45. Referring to FIG. 5, hard layer 25 and metal infiltrated reinforcement layer 35 contain hollow, closed, "crush zones" that are not penetrated during metal infiltration. The Al infiltration process causes aluminum to penetrate throughout the overall structure and solidifies within the material layers of open porosity, extending from one layer to the next, thus binding the layers together and integrating the structure. While molten aluminum is the embodiment illustrated other suitable metals include but are not limited to aluminum alloys, copper, titanium and magnesium, and other metal alloys cast from the molten liquid phase. The liquid metal infiltration process is described in U.S. Pat. No. 3,547,180 and incorporated herein by reference for all that it discloses. Referring to FIG. 3, the mold cavity may also include sections of spikes or rods 27 of the same dense ceramic or high density metal utilized by the reinforcement layers. These spikes or rods would be enveloped in aluminum 45 during the infiltration process.

The metal matrix composite armor containing the insert is next demolded or removed from the closed mold. A significant advantage of a lightweight armor system 10 according to the present invention is that the various layers (30,35, and 25) thereof comprise different materials which have different properties to increase the overall effectiveness of the armor system. For example, the hard layer 25 has a high compressive strength and acoustic impedance, thus making it ideal for the hard, projectile-shattering medium. The metal matrix composite interlayer 35 mechanically constrains (i.e. supports) the hard layer 25 and aluminum skin 45. The mechanical support provided by the metal matrix composite interlayer 35 delays the onset of shattering of the impact layers 25 and aluminum skin 45 that occurs on projectile impact. The delayed shattering of the impact layers 25 and aluminum skin 45 improves the performance of the armor system 10. The metal matrix composite interlayer 35 also dissipates and attenuates the stress wave produced by the projectile impact. The energy dissipation function is enhanced by the variable ratio of hard and ductile layers. That is, the outer cermet (i.e. those layers having a larger percentage of ceramic material) layers or hard layer 25 is harder than inner layer 35 and outermost backing layer 30. These differing material properties tend to absorb or attenuate the shock wave more effectively than is generally possible with a material that has uniform material properties throughout. Utilizing material layers of different CTE values produces compressive and tensioned layers throughout the composite armor after metal infiltration and solidification.

For example, high CTE AlSiC as a center layer, bounded by a low CTE ceramic plate at the top and bottom surface would result in compressive states at both the top and bottom sufaces thereby increasing fracture resistance. Furthermore, compressive forces on the surfaces would allow impact fractures to close or "heal".

It should be understood that the preceding is merely a detailed description of one embodiment of this invention and that numerous changes to the disclosed embodiment can be made in accordance with the disclosure herein without departing from the spirit or scope of the invention. Rather, the scope of the invention is to be determined only by the appended claims and their equivalents.

We claim:

1. An integrated layered armor, comprising:

A plurality of layers comprising at least one hard layer, at least one metal matrix composite layer, and at least one metal enveloping layer, each hard layer exhibiting a degree of hardness capable of shattering or stopping a projectile impacting thereon and dissipating at least a portion of the kinetic energy associated with the resulting projectile pieces which impact on said hard layer, wherein said metal matrix composite layer comprises a reinforcement material, said reinforcement material having a fraction of void volume, said metal matrix composite further comprising a metal, said metal infiltrated within said void volume of said reinforcement material during infiltration casting, wherein said reinforcement material further comprises a fraction of closed void spaces therein, said closed void spaces not infiltrated with said metal during said infiltration casting, said closed void spaces defining crush zones therein, said metal matrix composite layer exhibiting a degree of ductility which causes said metal matrix composite layer to yield under the force of impinging pieces of the shattered projectile which pass through an adjacent hard layer thereby dissipating at least a portion of the remaining kinetic energy, with each of said plurality of metal matrix composite layers formed by metal infiltration casting, said metal infiltration casting binding said plurality of layers together to form an integrated structure, said metal infiltration encapsulating said plurality of layers to form a dense hermetic metal matrix composite in the desired product shape geometry.

2. An integrated layered armor as in claim 1 wherein said reinforcement material is a ceramic selected from the group consisting of silicon carbide, silicon nitride, aluminum nitride, aluminum oxide, boron-nitride, diamond, carbon, and graphite.

3. An integrated layered armor as in claim 1 wherein said metal infiltrated within said void volume is selected from the group consisting of aluminum, copper, titanium and magnesium.

4. An integrated layered armor as in claim 1 wherein said metal matrix composite comprises at least 20% or more volume of said reinforcement material.

5. An integrated layered armor as in claim 1 wherein said reinforcement material is a ceramic.

6. An integrated layered armor as in claim 1 wherein said reinforcement material is a metal selected from the group consisting of depleted uranium, tungsten, and molybdenum.

7. An integrated layered armor as in claim 1 wherein said reinforcement material is glass.

8. An integrated layered armor as in claim 1 wherein said reinforcement material is a ceramic alloy.

9. An integrated layered armor as in claim 1 wherein said reinforcement material is a metal.

10. An integrated layered armor, comprising:

A plurality of layers comprising at least one hard layer, at least one metal matrix composite layer, and at least one metal enveloping layer, each hard layer exhibiting a degree of hardness capable of shattering or stopping a projectile impacting thereon and dissipating at least a portion of the kinetic energy associated with the resulting projectile pieces which impact on said hard layer, wherein said hard layer further comprises a fraction of closed void spaces therein, said closed void spaces not infiltrated with said metal during said infiltration casting, said closed spaces defining crush zones therein, said metal matrix composite layer exhibiting a degree of ductility which causes said metal matrix composite layer to yield under the force of impinging pieces of the shattered projectile which pass through an adjacent hard layer thereby dissipating at least a portion of the remaining kinetic energy, with each of said plurality of metal matrix composite layers formed by metal infiltration casting, said metal infiltration casting binding said plurality of layers together to form an integrated structure, said metal infiltration encapsulating said plurality of layers to form a dense hermetic metal matrix composite in the desired product shape geometry.

11. An integrated layered armor as in claim 10 wherein said hard layer is a dense ceramic selected from the group consisting of aluminum oxide, silicon carbide, boron nitride, silicon nitride, and tungsten carbide.

12. An integrated layered armor as in claim 10 wherein said hard layer is a high density metal selected from the group consisting of depleted uranium, tungsten, titanium and molybdenum.

13. An integrated layered armor as in claim 10 wherein said hard layer is a dense ceramic.

14. An integrated layered armor as in claim 10 wherein said hard layer is a metal alloy.

15. An integrated layered armor as in claim 10 wherein said hard layer is a ceramic alloy.

16. An integrated layered armor as in claim 10 wherein said hard layer is steel.

17. An integrated layered armor, comprising:

A plurality of layers comprising at least one hard layer, at least one metal matrix composite layer, and at least one metal enveloping layer, each hard layer exhibiting a degree of hardness capable of shattering or stopping a projectile impacting thereon and dissipating at least a portion of the kinetic energy associated with the resulting projectile pieces which impact on said hard layer, wherein said at least one enveloping layer includes spikes or rods integrated therein, said metal matrix composite layer exhibiting a degree of ductility which causes said metal matrix composite layer to yield under the force of impinging pieces of the shattered projectile which pass through an adjacent hard layer thereby dissipating at least a portion of the remaining kinetic energy, with each of said plurality of metal matrix composite layers formed by metal infiltration casting, said metal infiltration casting binding said plurality of layers together to form an integrated structure, said metal infiltration encapsulating said plurality of layers to form a dense hermetic metal matrix composite in the desired product shape geometry.

18. An integrated layered armor as in claim 17 wherein said enveloping layer completely encases said at least one hard layer and said at least one metal-matrix composite layer.

19. An integrated layered armor as in claim 17 wherein said enveloping layer is a metal selected from the group consisting of aluminum, aluminum alloys, copper, titanium, and magnesium.

* * * * *